US006692813B1

(12) United States Patent
Elder

(10) Patent No.: US 6,692,813 B1
(45) Date of Patent: Feb. 17, 2004

(54) MULTILAYER SPHERICAL BONDING CONSTRUCTION

(76) Inventor: Allen H. Elder, 174 E. Montecito Ave., Unit 3, San Gabriel Ct., Sierra Madre, CA (US) 91024

( * ) Notice: Subject to any disclaimer, the term of this patent is extended or adjusted under 35 U.S.C. 154(b) by 58 days.

(21) Appl. No.: 09/716,496

(22) Filed: Nov. 20, 2000

(65) Prior Publication Data

(65)

(51) Int. Cl.[7] ..... B32B 3/10; B32B 5/16

(52) U.S. Cl. ..... 428/143; 428/323; 428/338

(58) Field of Search ..... 428/143, 147, 428/148, 304.4, 318.6, 338, 323

(56) References Cited

U.S. PATENT DOCUMENTS 2,936,490 A 5/1960 Mason ..... 264/19
3,367,027 A 2/1968 Kata ..... 433/206
4,612,160 A * 9/1986 Donlevy et al. ..... 419/2
6,395,327 B1 * 5/2002 Shetty ..... 427/2.26

* cited by examiner

*Primary Examiner*—Ramsey Zacharia
(74) *Attorney, Agent, or Firm*—Eric K. Satermo

(57) ABSTRACT

A system and method of bonding is disclosed which is suitable for providing a strong interlocking adhesive bond between two surfaces. At least one bonding surface is provided with multiple layers of spherical shaped protrusions. The multilayer spherical bonding surface is formed from the substrate and therefore is continuous. Many methods may be employed to form this surface, including the lost wax casting process. Such bonding surfaces provide good interlocking properties for bonding agents such as epoxy resins and ceramics. In addition, the uniform curvature of the spherical particles themselves reduces points of stress thereby substantially reducing or even eliminating the formation of stress fractures.

12 Claims, 2 Drawing Sheets

MULTILAYER SPHERICAL BONDING CONSTRUCTION

FIELD OF THE INVENTION

The present invention relates to bonding and more particularly to the preparation of two surfaces for bonding with a bonding agent.

BACKGROUND OF THE INVENTION

There are numerous methods that have been used for joining together two or more surfaces. The more common methods include welding, joining, or bonding. Two surfaces may be welded together by melting or dissolving them together. Two surfaces may be joined together using a suitable piece of strong material that can be pushed or compressed in some manner. Included in this category are bolts, screws, nails, and rivets. Two surfaces may be bonded together using a bonding agent that forms an adhesive bond to both surfaces. Pressure sensitive adhesives commonly employed for use in labels are a prime example of this type of bonding. Two surfaces may also be mechanically bonded together with a bonding agent that hardens to a strong rigid material. A good example of this bonding is the use of glue to bring two surfaces of wood together.

In the case of welding two surfaces together, if carried out properly with the right materials, very strong bonds result which can be as strong or even stronger than the two substrates themselves. The welding of two metal surfaces is accomplished by employing a small but intense area of heat at the site where the two pieces are to be joined. The heat is so intense that the metal of both pieces melts and flows together. Quite often additional metal is added to the weld during the process. A welding rod of a suitable material (usually the same material as the substrate) is placed in the heated area so that it melts and flows into the weld to build it up. Most metals require very high temperatures and as such only certain conditions are suitable for welding. These include electrical discharge for arc, tig, mig, and spot welding and high temperature gas mixtures such as acetylene-oxygen for gas welding.

Unfortunately, welding cannot always be used to bond two metal surfaces together. In many instances the substrates may not be made of a material that can be welded. In addition, even if the substrate is made of a suitable material it may not be of suitable dimensions for welding. It may be too thin making welding without bum through difficult or even impossible. One surface may be on a thicker substrate than the other resulting in uneven heating or even thermal distortion.

The welding together of two plastic surfaces requires that the plastic is capable of either melting by the application of heat, or dissolving into a solvent. In the case of joining plastic surfaces together by heat, the plastic must have a suitable melting point that allows the material to flow together. Many plastics will soften but not easily melt. In such instances it is often practice to use an alternative method to weld the two pieces together without the need to apply heat. Some plastics are soluble in common solvents. For example polystyrene is substantially soluble in toluene. If a drop of toluene is placed onto a piece of polystyrene and a second piece of polystyrene placed on top, the toluene will dissolve some polystyrene from both surfaces. This layer of polystyrene solution will mix into both surfaces. When the toluene evaporates, the pieces will be firmly joined. Sometimes it is practice to dissolve some of the plastic into the solvent prior to application between the two surfaces to be joined. The familiar plastic model kits sold in hobby shops use this system. The individual model pieces are made from polystyrene, and the glue is a solution of polystyrene dissolved in toluene. This system works well because when the two pieces are bonded together with this glue, the final joint that results is the same material as the substrate (polystyrene). In this respect a true weld has been achieved.

While effective for joining certain types of plastic materials together, welding by heat and/or solvent will not work for the stronger more advanced plastics used in composites. The reason for this is that a weld derives strength by forming a continuous bond of substantially the same material from one substrate to the other. In other words, The two pieces that are welded together literally become one. It is as if the resultant piece was initially made as a single piece. In order for this to take place, the substrate material must become fluid and flow to become at least part of the joint. Advanced polymers commonly employed in composites contain a substantial amount of crosslinking.

The crosslinking keeps the polymer rigid and strong. Crosslinking also prevents the polymer from being welded by heat or solvent. Heavily crosslinked polymers will not melt. If heated they will burn or degrade without melting. Heavily crosslinked polymers will not truly dissolve in solvents. They may swell or even become weak enough to pull apart, however they will not dissolve to form a free flowing liquid.

The joining of two pieces together using a third piece that interconnects both pieces to be joined is a very common practice. A good example of this method of joining is the common nail. A nail is a relatively long and narrow piece of metal having a sharpened end and a blunt end. When joining two pieces together using nails, one piece is placed on top of the other. The sharp end of the nail is positioned into the top piece and directed toward the bottom piece. A hammer is then used to strike the blunt end causing the nail to be driven into both pieces. The result is that the nail holds both the top piece and the bottom piece together. While common for joining two wooden boards together, nails are relatively easily pulled out. Furthermore if nails are to be used for joining two pieces of material together the material must yield to the nail without breaking or shattering. Thus while effective for joining two pieces of wood, nails are not always best suited for joining hard or brittle materials together.

Other examples of this type of fastening include rivets, bolts, and screws. Rivets are fasteners having a wide end and a narrow end that is expandable. Using rivets requires a hole to be drilled through both substrates. The holes are aligned and the rivet pressed into this hole until the wide end rests firmly against the top piece. When the rivet has been pressed all of the way in, the narrow end is expanded so that it cannot work its way out. Rivets are commonly used to join thin sheets of metal together.

Bolts and screws are threaded fasteners that can either be threaded directly into a substrate or alternatively can have a threaded nut screwed onto the free end to tighten the substrates together. In either case, these fasteners join two pieces together by virtue of the fastener itself providing an independent connection between the two pieces.

The bonding of two substrates together with a bonding agent relies on both the strength of the bonding agent as well as adhesion of the bonding agent to both joining surfaces. Adhesive bonding between a bonding agent and a surface relies on molecular attraction and compatibility between the bonding agent and the substrate. If the surface to be bonded and the bonding agent can form true chemical bonds which cross the interface between them, then a strong bond can form based on molecular attraction alone. The nature of this attraction can be that of covalent bonds that result from surface reactions between the bonding substrate and bonding agent, or alternatively, Ionic bonds may form between oppositely charged atoms or groups of atoms. Weaker attractive forces may also play a significant role in adhesion such as hydrogen bonding, polar forces or even the weak attractions that result from the electron clouds in the atoms of one molecule being weakly electrostatically attracted to the positively charged nuclei in the atoms of other molecules.

This type of bonding, while being exceedingly strong, is not easily achieved. In addition, substantial improvements can be obtained by increasing the available surface area. This is usually done by increasing the surface roughness of the substrate. With adhesive bonding the surface of the substrate in the bonding area must be absolutely clean and free from foreign contamination. Furthermore contamination must be removed on a molecular level. In practice this is exceedingly difficult to achieve. Because of this, the use of surface adhesion alone for bonding is very difficult to achieve and in practice many bonding agents rely on at least some mechanical interlocking between the bonding agent and the intended bonding surface of the substrate.

In practice, adhesive bonding by itself is rarely if ever encountered. There is usually some surface roughness which results in some mechanical interlocking of the bonding agent to the substrate. Both factors combined determine if a bonding agent will adequately fasten together two substrates. In other words adhesive bonding usually relies at least partly on mechanical bonding.

Mechanical bonding resulting from the interlocking between a bonding agent and a substrate surface naturally occurs to some extent owing to the fact that most surfaces are inherently rough. This is especially true if the surface roughness was increased for the purposes of promoting adhesion. Surface roughness enhances bonding between a bonding agent and the substrate surface by increasing the available surface area for bonding and by providing sites where mechanical interlocking of the bonding agent with the substrate can occur.

Many bonding agents such as polymers used in the composite industry tend to shrink when cured. This shrinkage can be in excess of one percent. Such shrinkage may result in the delamination or separation of the bonding agent from the substrate or cause the formation of stress that can result in delamination at a later time. In either case, the shrinkage of common curable polymer based bonding agents such as epoxy resins when cured represents substantial bonding issues.

Fillers are often mixed with bonding resins prior to curing. One particularly common filler is fumed silica. This material is a form of silicon dioxide which is very small in particle size. Because there is less resin, (some of the volume is now occupied by the inert filler) overall shrinkage is reduced. Other fillers include hollow polymeric microballons such as 410 Microlight available from West System. West system is a registered trademark of Gougen Brothers, Inc., P.O. Box 908, Bay City, Mich. 48707. Flocked cotton fiber, microscopic glass bubbles, and glass fibers cut to relatively short lengths of less than about one inch.

One particularly interesting example of the use of fillers to reduce shrinkage is outlined in U.S. Pat. No. 4,108,813. Intermeshing spherical quartz sand particles are used to reduce the shrinkage of flooring cement along with the addition of smaller spherical plastic beads to improve flow characteristics. The result is a low viscosity mixture that hardens into a dense cement floor structure with very little shrinkage.

In addition to reducing the shrinkage of curable bonding agents, many fillers increase bulk strength and often improve overall adhesion. Unfortunately, the use of fillers with curable bonding agents does not always guarantee that a strong and permanent bond will result.

The best way to assure that a strong and permanent bond will form between a bonding agent and substrate is by way of mechanical anchorage. Even in the absence of adhesive forces mechanical anchorage by a bonding agent to a surface by physical interlocking assures a good bond. In the case of the rivet, in order to separate the two pieces, the rivet must be broken. Although there are no adhesive forces between the rivet and the substrates, mechanical interlocking provides a strong bond. In a similar manner when a bonding agent is attached to a substrate by mechanical interlocking anchorage either the bonding agent or the substrate must be broken in order to achieve separation.

Ideally it is best practice to provide a strong bond between a substrate and bonding agent that has mechanical interlocking as well as good surface adhesion. A good example of this type of bonding is the use of wood glue. Wood glue is a water based polar polymer emulsion that is compatible with the surface of wood. Often these polymer emulsions contain polyvinyl alcohol as an additive or as part of the polymers that make up the glue itself. Polyvinyl acetate is also employed with many wood glues which of course is polar by virtue of the ester group of acetic acid. Hydrogen bonding and polar forces result in good adhesion of the glue to the wood. In addition to wood having a high polarity it also has a relatively high porosity. The wood glue is actually absorbed into the wood to form a mechanical interlocking bond.

When two or more pieces of wood are glued together in this manner the resulting bond is often stronger than the wood itself.

In order to provide a mechanical interlocking bond between a bonding agent and a substrate it is common practice to roughen the surface or even drill small holes. While this practice often produces strong bonding by improving mechanical anchorage, it has one major drawback. Sharp edges resulting from scratching or drilling holes in the substrate become points of stress which can later initiate cracking or even breakage of the bonding agent/or agents. Because of this, numerous methods have been employed to enhance mechanical anchorage of a bonding agent to a bonding surface while minimizing points of stress.

U.S. Pat. No. 4,202,055 outlines the use of ceramic particulate of a material having a diameter of between 0.5 mm and 1.0 mm incorporated in a polymer for the purposes of anchoring a highly stressed endoprostheses. With time after implantation, the ceramic material dissolves away and is replaced by bone tissue. Bioactivating bonding residues aid in bone growth. The result is bone growth in spherical nodules embedded into a polymer.

The spherical shape of the resulting bone nodules significantly reduces the chances of stress fracture formation over time and under the conditions of abuse. Although advantageous in many respects, in the case of brittle bones, the point where the spherical nodule meets the main surface of the bone is a possible failure point.

Another related bonding method involves the attachment of particulate material to a substrate prior to bonding. U.S.

Pat. No. 4,927,361 uses this technique to provide dental attachments that will form a good bond to a tooth surface. The particulate coating may take the form of discrete particles, or alternatively may form one or more layers. The result is that mechanical interlocking occurs between the substrate and the adhesive material that bonds the substrate to the tooth.

U.S. Pat. No. 4,854,496 discloses a method of producing a porous metal-coated substrate by diffusion bonding of metal powder particles. Pressure is used to push the particles into the substrate allowing for bonding to occur at reduced temperatures. The diffusion process itself is carried out in a non-reactive atmosphere below the temperatures normally required for sintering. The result is a sintered porous surface which is suitable for bonding to a second substrate and which provides good mechanical interlocking with a suitable bonding agent.

Also worthy of mention is the use of discrete microspheres continuous with a surface substrate. Experiments in this area have been carried out in the area of dentistry. Allan H. Elder, the author of this patent, has prepared bonding surfaces suitable for bonding Maryland bridges. Although these results were successful, improved interlocking characteristics may be obtained by employing multiple layers of these spherical shaped particles.

The above prior art references disclose several methods for achieving bonding between two surfaces. Of particular interest is the use of substantially spherically shaped particles on a substrate surface to improve bonding. The result is a bonding surface having interlocking characteristics with virtually no tendency to produce points of stress.

While these methods provide bonding substrates for various purposes, further improvements in bonding may be realized by employing the teachings of this invention. For example, no mention is made of a truly continuous piece of substrate material possessing interlocking characteristics prior to bonding. The advantages of such a substrate are that it will have material properties that are uniform throughout and therefore posses few if any areas of discontinuity. Such a substrate would be desirable owing to the fact that areas of discontinuity represent possible sources of failure. Such areas or zones of discontinuity include interfacial zones, intercrystalline phase boundary zones, and possible surface contamination at the interface. Employing multiple layers of bonding particles increases the number of these zones in these substantially discontinuous structures. The result is an increase in the likelihood of stress cracks, detachment, or even breakage.

It is therefore an object of this invention to provide a bonding surface having a continuous phase with the substrate.

It is a further object of this invention to provide a bonding surface having good interlocking properties.

It is a further object of this invention to provide a bonding surface having virtually no points of stress.

It is still another object of this invention to provide a bonding surface which may be easily prepared using low cost materials and equipment.

SUMMARY OF THE INVENTION

This invention therefore proposes the preparation of one or more bonding surfaces consisting of multiple layers of substantially spherically shaped nodules protruding from a continuous substrate. These protruding nodules are part of the substrate itself and are formed during the manufacturing process. The resulting substrates have unusually good bonding properties to a wide range of materials and exhibit virtually no tendency to initiate breakage or failure.

Various methods may be employed to prepare such substrates including the lost wax process. The lost wax process has been employed for years in the metal casting industry and is a preferred method for preparing many of the bonding substrates outlined of this invention.

The bonding substrate may be made from any number of materials including pre-formed composite components, metal parts and pieces, or even ceramic materials such as porcelain.

DETAILED DESCRIPTION OF THE INVENTION

Figure 1:
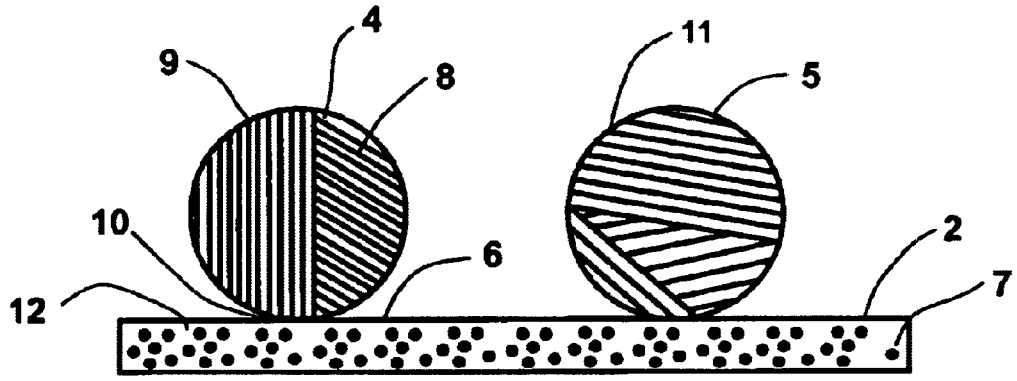
FIG. 1 Prior Art
FIG. 1 shows an enlarged view of a bonding surface of prior art employing spherical particles that have been diffusion bonded under pressure to a substrate.

FIG. 1 shows a bonding surface 2 prepared in accordance of the prior art practice of sintering, namely, the use of pressure to push particles of similar or the same material into a surface at elevated temperatures. Spherical particles 4 and 5 are shown embedded into surface portion 6 of substrate 7. Also shown are outermost surface portions 9 and 11 of spherical particles 4 and 5. The resulting bond that forms between surface portion 6 of substrate 7 and outermost surface portions 9 and 11 of spherical particles 4 and 5 represents a zone of discontinuity in the direction, size and type of crystals of material. In particular, a phase boundary 10 exists at the point of contact. Phase boundary 10 is susceptible to breakage. Individual crystals 8 of spherical particles 4 and 5 are oriented in different directions than individual crystals 12 of substrate surface portion 6.

Figure 2:
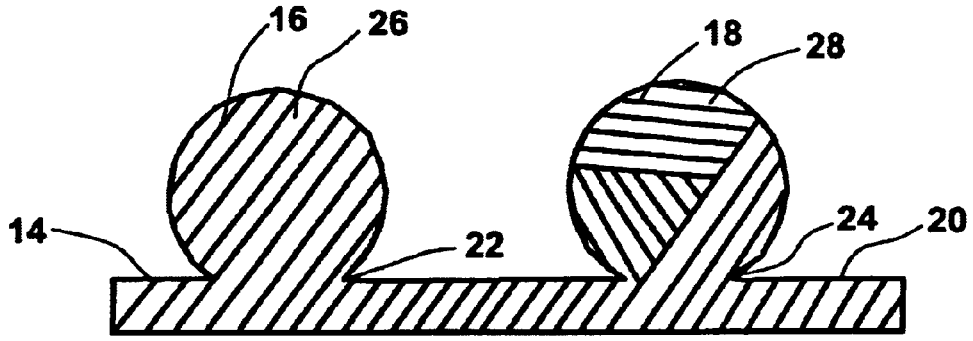
FIG. 2 shows an enlarged view of a bonding surface employing spherical particles having a continuous phase with the substrate.

FIG. 2 shows a bonding surface 14 prepared in accordance with the continuous phase and material aspects of this invention. Spherical particles 16 and 18 are continuously attached to substrate 20 at attachment points 22 and 24. Individual crystals 26 and 28 are also shown. As an be seen from the diagram, particle 16 has crystals 26 which are continuous in phase, structure, and direction with substrate 20. As such, attachment point 22 is highly resistant to breakage and thus forms a very strong bond between substrate 20 and particle 16. It can also be seen that particle 16 itself is very strong due to the fact that the direction of crystallinity remains the same throughout with no intercrystalline phase boundaries present.

Particle 18 is not as strong as particle 16, however there is substantial continuity in the direction of crystallinity at attachment point 24. Because of this continuity, attachment point 24 is also quite strong and resistant to breakage.

Figure 3:
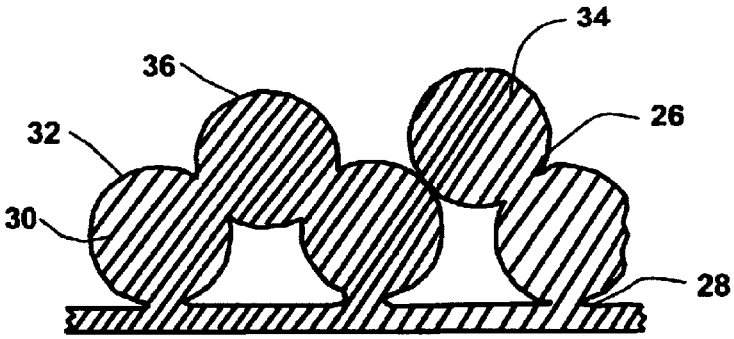
FIG. 3 shows a bonding surface of this invention employing multiple layers of spherical particles that were formed as part of the substrate.

FIG. 3 shows a bonding surface having multiple layers of spherical particles with uniform material properties throughout. Bonding surface 26 is shown having a substrate portion 28 and spherical particles 30. Spherical particles 30 are numerous and form first layer 32. Additional spherical particles 34 are also shown. Spherical particles 34 form a second layer 36 on top of first layer 32. This multiple layer aspect of this invention provides a substantially porous surface with good interlocking properties to liquid bonding agents. Such liquid bonding agents are materials which are applied to the surface as liquids, penetrate into the voids between particles and harden to form a solid mass. The result is a strong interlocking bond having virtually no unwanted points of stress. There are numerous methods that may be employed to form this type of structure; however, the lost wax process is one of the easiest methods to describe and use.

The lost wax process starts out by making a wax blank part that is identical in dimensions to the desired finished part. This wax part is then placed into a ceramic material that is resistant to heat and somewhat porous. The wax part is then used to make a mold by pouring the ceramic material over the wax blank and letting the ceramic material harden. Once hard, the ceramic mold with the wax blank is heated to burn out the wax leaving a void space in the shape of the desired part. The mold is then used to make the part out of the desired material. Once finished, the mold may be broken and the part removed. This process is well known art and is sometimes referred to as investment casting. It is a standard method used to make numerous parts in industry. It is well suited for casting final parts in metal. The part that is used to make the mold does not have to be wax. There are several other materials such as nylon or polyethylene that can be used as well.

Figure 4:
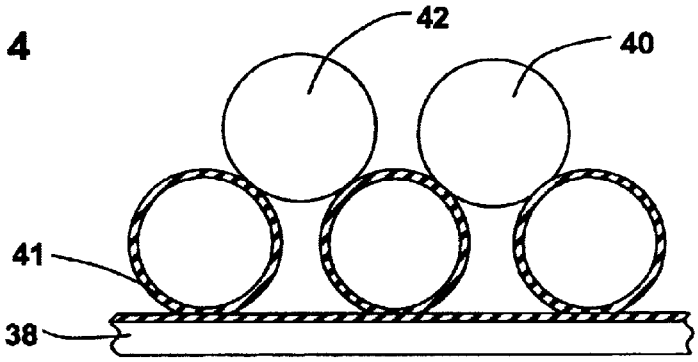
FIG. 4 shows a part which is used to make a lost wax mold for casting the final bonding substrate of this invention.

FIG. 4 shows a wax and nylon part 42 that can be used to make a lost wax type of mold for casting the final bonding surface of this invention. Wax substrate 38 is shown having multiple layers of nylon beads 40 attached. Pressure sensitive adhesive 41 is also shown which is used to temporarily hold nylon beads 40 to wax substrate 38 and to each other. Wax and nylon part 42 having multiple layers of nylon beads 40 may be easily prepared. Wax substrate 38 is first coated with a thin layer of a pressure sensitive adhesive 41. Suitable pressure sensitive adhesives have low surface energies and may be based on rubber. Numerous companies manufacture these adhesives including Avery Dennison Corporation of Pasadena, Calif. Small nylon beads 40 are then sprinkled onto this tacky surface to form a single layer. A thin second layer of pressure sensitive adhesive 41 is then applied to the top surface of attached nylon beads 40. A second layer of nylon beads 40 is then applied to form the second layer. Numerous layers may be applied in this manner, however the best number of layers will depend on the particle size of the spherical beads and other parameters.

Figure 5:
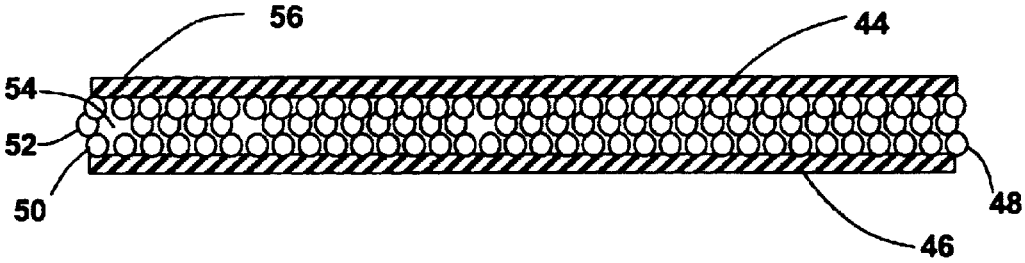
FIG. 5 shows two parts that have been bonded together using the teachings of this invention.

FIG. 5 shows two pieces of material bonded together using the teachings of this invention. Complete construction 44 is shown in cross section. Metal substrate 46 is shown having a first layer 48 of spherical shaped particles 50 firmly attached. Spherical particles 50 are made of the same material as metal substrate 46 and are continuous in phase with the substrate. Also shown is a second layer 52 of spherical particles 50.

Second layer 52 of spherical particles is continuous in material and phase with first layer Because of this, there is virtually no tendency for spherical particles 50 to separate from either each other or from metal substrate 46. The strength advantages of the continuous material and continuous phase nature of these constructions are substantial. The reasons for this are well known in the art of material science. Many materials have points of weakness when the direction of crystallinity changes. This zone of changing crystallinity is often referred to as a crystalline phase boundary. A phase boundary may result from a change in material, a change in crystalline structure, or even a change in the direction in crystal growth. Materials possessing these phase boundaries are susceptible to breakage at the boundary. Bonding agent 54 is shown interlocked into the voids between spherical particles. Although the phase of bonding agent 54 is clearly different from that of metal spherical particles 50, the bonding mechanism of bonding agent 54 relies on mechanical interlocking.

Second substrate 56 is also shown. Second substrate 56 may be of the same material as substrate 46, or alternatively may be of a different material. Spherical particles 58 are shown attached to substrate 56. Spherical particles 58 are composed of the same material as substrate 56. Spherical particles 58 are also continuous in phase with substrate 56.

Those skilled in the art will understand that the preceding exemplary embodiments of the present invention provide a foundation for numerous alternatives and modifications. These other modifications are also within the scope of the limiting technology of the present invention. Accordingly, the present invention is not limited to that precisely shown and described herein but only to that outlined in the appended claims.

What is claimed is:

1. A bonding surface suitable for forming a bond with a bonding agent, said bonding surface comprising:

a substrate portion including a plurality of layers of spherical particles fixedly attached thereto at a zone of attachment;

said spherical particles comprising the same material as said substrate; and said material of said spherical particles being in continuous phase with said same material as said substrate at said attachment zone.

2. A bonding surface as claimed in claim 1 wherein said substrate and said spherical particles are formed together in one step.

3. A bonding surface as in claim 2 wherein said substrate and said spherical particles are formed in accordance with a lost wax process.

4. A bonding surface suitable for forming a bond with a bonding agent, said bonding surface comprising:

a substrate portion having a plurality of layers of spherical particles fixedly attached thereto;

said spherical particles comprising the same material as said substrate; and said material of said spherical particles being in continuous phase with said same material as said substrate.

5. A bonding surface as in claim 4 wherein said substrate and said spherical shaped particles are formed together on one step.

6. A bonding surface as in claim 5 wherein said substrate and said spherical particles are formed in accordance with a lost wax process.

7. A bonding surface for forming a bond with a bonding agent, the bonding surface comprising:

a substrate; and a layer of particles fixed to the substrate;

the particles being made from the same material as the substrate; and the material of the particles being in continuous phase with the material of the substrate.

8. The bonding surface of claim 7 further comprising another layer of particles fixed to the layer of particles fixed to the substrate.

9. The bonding surface of claim 8 wherein all of the particles are made from the same material as the substrate.

10. The bonding surface of claim 9 wherein the material of all of the particles are in continuous phase with the material of the substrate.

11. The bonding surface of claim 7 wherein the substrate and the particles are fixed in accordance with a lost wax process.

12. The bonding surface of claim 7 wherein the substrate and the layer of particles are fixed together by casting.

* * * * *